US010377597B2

(12) United States Patent
Perini

(10) Patent No.: US 10,377,597 B2
(45) Date of Patent: Aug. 13, 2019

(54) METHOD FOR DISTRIBUTING GLUE ON TUBULAR CARDBOARD CORES IN REWINDING MACHINES

(71) Applicant: FUTURA S.P.A., Capannori Fraz. Guamo (IT)

(72) Inventor: Fabio Perini, Viareggio (IT)

(73) Assignee: FUTURA S.P.A., Capannori (LU), Fraz. Guamo (IT)

( * ) Notice: Subject to any disclaimer, the term of this patent is extended or adjusted under 35 U.S.C. 154(b) by 194 days.

(21) Appl. No.: 15/545,049

(22) PCT Filed: Nov. 11, 2015

(86) PCT No.: PCT/IT2015/000277
§ 371 (c)(1),
(2) Date: Jul. 20, 2017

(87) PCT Pub. No.: WO2016/116954
PCT Pub. Date: Jul. 28, 2016

(65) Prior Publication Data

US 2018/0009619 A1 Jan. 11, 2018

(30) Foreign Application Priority Data

Jan. 21, 2015 (IT) ..... FI2015A0008

(51) Int. Cl.
*B65H 19/28* (2006.01)
*B65H 19/22* (2006.01)
(Continued)

(52) U.S. Cl.
CPC ..... *B65H 19/283* (2013.01); *B05B 1/205* (2013.01); *B05B 1/30* (2013.01); *B05B 9/04* (2013.01);
(Continued)

(58) Field of Classification Search
CPC .. B65H 19/283; B65H 19/2269; B05B 1/205; B05B 1/30; B05B 9/04; B05B 12/02
See application file for complete search history.

(56) References Cited

U.S. PATENT DOCUMENTS 7,469,856 B1 12/2008 Tsai
2002/0005164 A1 1/2002 Gambini
(Continued)

FOREIGN PATENT DOCUMENTS

EP 1 249 417 A2 10/2002
EP 1541245 A2 6/2005
(Continued)

*Primary Examiner* — Daniel McNally
(74) *Attorney, Agent, or Firm* — McGlew and Tuttle, P.C.

(57) ABSTRACT

Method for applying glue on tubular cores for the production of logs of paper material comprising the step of supplying in sequence more tubular cores (1) along a predetermined advancing direction (A) and the step of applying on each of said cores (1) a predetermined amount of glue, and the glue is applied on the tubular cores (1) from the above. While advancing along said direction (A) and without interrupting their run, the tubular cores (1) intercept for a predetermined time the glue (EG) released by a predetermined number of nozzles (114); and during said time interval the glue (EG) is both on the nozzles (114) and the tubular cores (1) given the absence of any element interposed between the nozzles and the tubular cores.

17 Claims, 6 Drawing Sheets

(51) Int. Cl.

| | |
|---|---|
| ***B05B 1/20*** | (2006.01) |
| ***B05B 1/30*** | (2006.01) |
| ***B05B 9/04*** | (2006.01) |
| ***B05B 12/02*** | (2006.01) |

(52) U.S. Cl.
CPC ..... *B05B 12/02* (2013.01); *B65H 19/2269* (2013.01); *B65H 2701/176* (2013.01)

(56) References Cited

U.S. PATENT DOCUMENTS

| | | | | |
|---|---|---|---|---|
| 2003/0047639 | A1 | 3/2003 | Betti et al. | |
| 2007/0023562 | A1 | 2/2007 | Perini | |
| 2010/0237179 | A1* | 9/2010 | De Matteis ..... | B65H 19/2269<br>242/521 |

FOREIGN PATENT DOCUMENTS

| | | | |
|---|---|---|---|
| EP | 1519886 | B1 | 4/2006 |
| EP | 1679274 | A2 | 7/2006 |
| EP | 1 923 342 | A2 | 5/2008 |
| EP | 2 045 201 | A1 | 4/2009 |

* cited by examiner

METHOD FOR DISTRIBUTING GLUE ON TUBULAR CARDBOARD CORES IN REWINDING MACHINES

The present invention relates to a method for distributing glue on tubular cardboard cores in rewinding machines, in particular for the production of rolls or "logs" of paper material.

It is known that the production of paper logs, from which are obtained, for example rolls of toilet paper or rolls of kitchen paper, involves feeding a paper web, consisting of one or more superimposed paper plies, on a predetermined path along which several operations are executed before proceeding to the formation of the logs, including a transverse pre-cut of the web to form the pre-cut lines which divide it into separable sheets. The formation of logs implies the use of cardboard tubes, commonly called "cores", on whose surface a predetermined amount of glue is distributed to enable the bonding of the paper web on the cores progressively introduced into the machine that produces the logs, commonly said "rewinder". The formation of logs implies, in addition, the use of winding rollers downstream of the glue distribution station, which make each core to rotate around its own longitudinal axis thus determining the winding of the web on the core. The process ends when a preset number of sheets is wound on the core, with the gluing of a flap of the last sheet on the underlying one of the roll thus formed (so-called "flap closure operation"). At this point, the log is discharged from the rewinder.

EP1519886 discloses a rewinding machine that operates according to the scheme described above. U.S. Pat. No. 7,469,856 and EP 1679274 disclose sizing systems for the production of logs in which the glue is applied to the cores from the bottom and the excess of glue falls back into the same tank containing the glue, causing possible contamination of the glue with particles of paper material and, thus, compromising the quality of the gluing step. US2003/0047639 discloses a rewinder provided with a device comprising a series of nozzles located above a path followed by the tubular cores introduced in the rewinder. These nozzles spray glue on the cores that pass along said path. Since the glue is sprayed on the surface of the cores, the gluing is necessarily imprecise. The same document describes the possibility of using the gluing rollers immersed in a tank containing glue, but this implies a contamination of the adhesive as mentioned earlier, or more generically the possibility of using pads presumably intended to come into contact with the cores that, consequently, are slowed and receive an excessive amount of glue.

EP1541245 discloses a device for applying glue to the cores or to the end flap of a paper log with a glue applicator formed by a wire wound in a closed circuit on at least two pulleys which returns to a tank the glue that is not absorbed by the paper and, therefore, implies the contamination of the glue in the tank because it constitutes a carrier for the dust released by the paper of the web and the cardboard of the cores.

EP2045201 discloses a rewinder for making paper logs with a gluing device comprising a glue sprayer destined to spray glue on the cores at a waiting position upstream of a cradle above which winding rollers are provided. Since the glue is sprayed on the surface of the cores, the gluing is necessarily imprecise.

It is still strongly felt the need to avoid contamination of the glue by the paper or cardboard on which the glue itself is applied. At the same time, there is the need to ensure a fast flow of the cores at the entrance of the rewinders and to reduce as much as possible the consumption of the glue without compromising the quality and accuracy of gluing.

The main purpose of the present invention is to eliminate the aforesaid drawbacks and to provide a gluing system that meets the current production needs without, however, introduce structural or functional complications or higher costs linked to the production of the system itself or the production of the paper logs.

This result has been achieved, in accordance with the present invention, by providing an operating method having the features indicated in claim 1. Further features of the present invention are the subject of the dependent claims. Thanks to the present invention, it is possible to impose to the glue distributed on the tubular cores a predetermined general shape avoids the drawbacks of the known machines, allowing the production of logs featuring a high quality. Moreover, a device in accordance with the present invention is structurally and functionally simple and, therefore, very economical in relation to the advantages offered. In addition, there is the fact that a device in accordance with the present invention allows the control the amount of glue dispensed with sufficient accuracy. A gluing system in accordance with the present invention also offers the possibility to avoid contamination of the glue by the cardboard on which the glue itself is applied. At the same time, the present gluing system offers the possibility to ensure a fast flow of the cores at the entrance of the rewinders and to reduce as much as possible the consumption of the glue without compromising the quality of the gluing.

These and other advantages and features of this invention will be best understood by anyone skilled in the art thanks to the following description and to the attached drawings, provided by way of example but not to be considered in a limitative sense, wherein.

Figure 7:
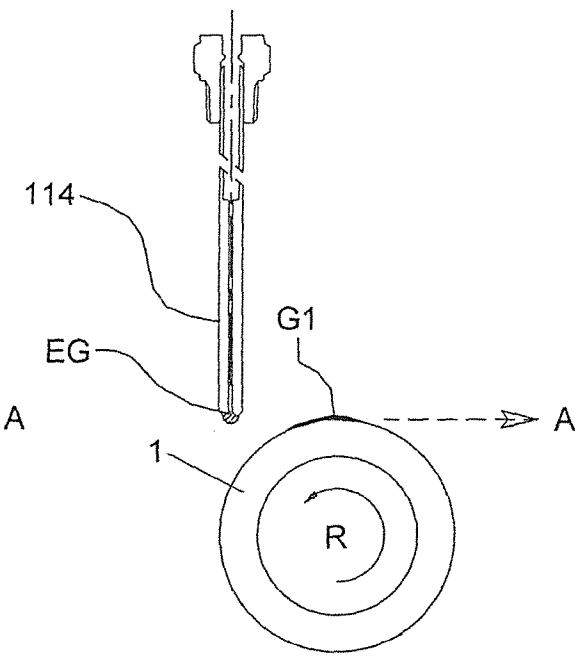
Figure 6:
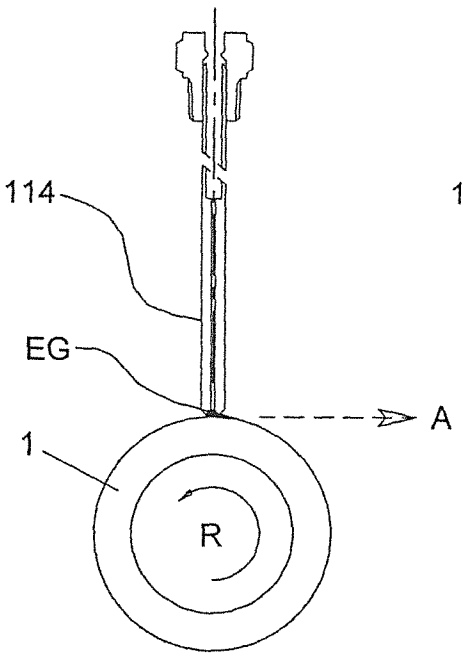
Figure 5:
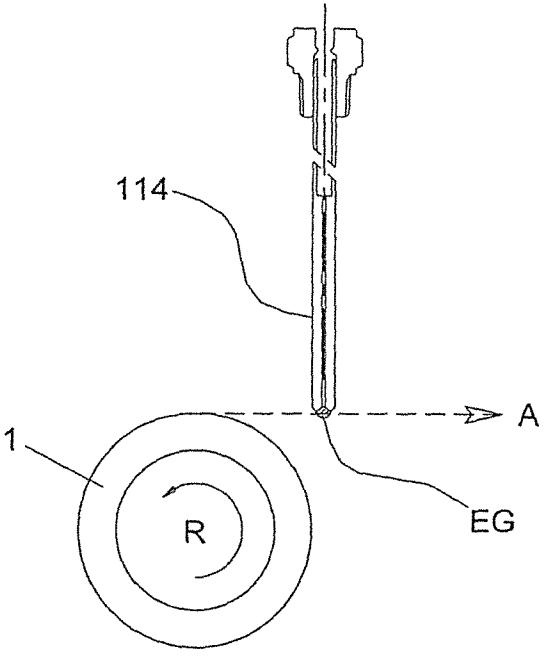
Figure 9:
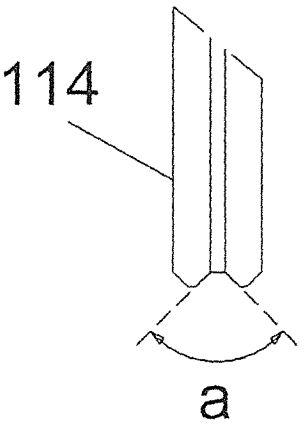
Figure 8:
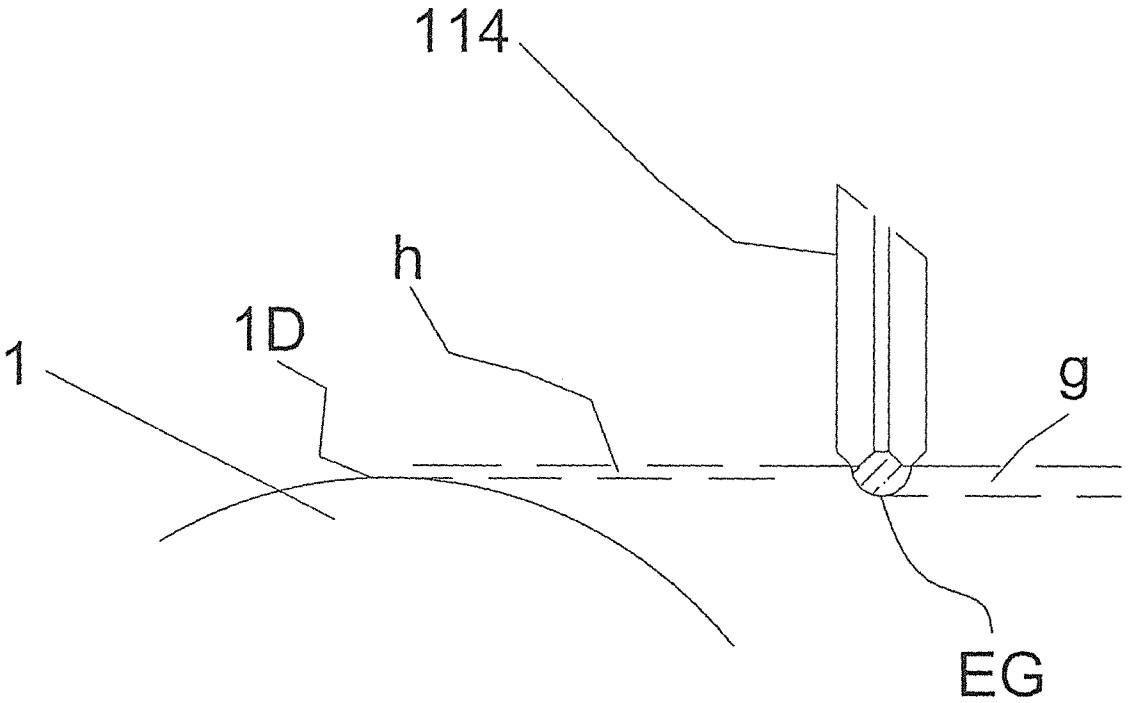

FIGS. 5-7 schematically show the positions of a tubular core which passes under a dispenser of a device in accordance with this invention;

FIG. 8 is an enlarged detail of FIG. 5;

FIG. 9 shows a detail of FIG. 8.

A device for the implementation of a method in accordance with the present invention can be used, for example, in a rewinder (RW) of the type comprising:

- a station (F) for feeding the cores (1) from an accumulator (S), in which it is arranged and acting a rotating feeder (RF) which picks up a core (1) at a time and introduces it in the gluing device (GD) described below;
- means for feeding and transversally pre-cut a paper web (2) formed by one or more superimposed paper plies, with a series of guide rollers (R1, R2, R3) and pre-cutting rollers (RC) arranged along a supply and pre-cutting path for the paper web (2);
- means for winding the paper web (2) on a tubular cardboard core (1) in a winding station, with a first winder roller (R4) located downstream of said feeding and pre-cutting rollers (R1, R2, R3, RC), and with other two winding rolls (R5, R6) vertically aligned and positioned and acting close to the first winder roller (R4), the second and the third winding roller (R5, R6) being arranged above a curved guide (3) that, in cooperation with the first winder roller (R4), delimits a channel (CH) downstream of the gluing device (GD), the channel (CH) being crossed in sequence by the tubular cardboard cores (1) exiting from the gluing device (GD).

The first winder roller (R4) also has the function of guiding the paper web (2) coming from the supply and pre-cutting rollers.

The aforesaid channel (CH) delimits the last leg of the path followed by the paper web (2) and also of the cores (1) exiting from the gluing device (GD).

On the cores (1) it is applied a predetermined amount of glue which serves to adhere the paper web (2) on the same cores (1), according to methods known to the skilled in the art, while the same core (1) go along a predetermined direction (A) to reach the channel (CH). For example, the cores (1) feeding is obtained by using mutually opposite motorized belts (4, 5) which engage the cores (1) coming from the feeding section and force them to travel along a predetermined path upstream of the channel (CH). Said belts (4, 5) may impose the cores (1) to be translated, if driven at the same speed, or also to roto-translate, if operated at different speeds. In FIGS. 5-7 the cores (1) are subject to rotation and translation (the translation is along the direction "A"; the rotation is indicated by arrow "K"). The gluing device comprises a glue supply unit (GS) and a glue distribution unit (GD).

The supply unit (GS) feeds the glue to the distribution unit (GD), which then distribute it, from above, on the cores (1).

More particularly, the supply unit (GS) comprises a first reservoir (100) in which is stored the glue (G) and which is connected, by a pipe (101), to a second tank (102) provided with a valve (103) controlled by a float (104) to maintain constant the level of the glue inside it. The valve (103) and the float (104) are known per se.

Preferably, the second tank (102) is depressed, to facilitate the degassing of the glue (G). For this purpose, on the second tank (102) acts a vacuum pump (105) controlled by a pressure switch (106) that detects the pressure in the second tank (102).

The second tank (102) has an output connected, via a corresponding conduit (107), with a pump (108) provided with intake and outlet valves (109, 110). Also the pump (108) is of the known type. In particular, it is a double cylinder pneumatic pump.

The output of the pump (108) is connected, via a further duct (111), with the glue distribution unit (GD).

More particularly, the conduit (111) connects the pump (108) with the input of a regulator valve (112) which in turn is connected, on its exit, with a distributor (119) on which are mounted more nozzles (114) from which comes out the glue intended to be applied on the tubular cores (1) intended for rewinder and transiting below the same nozzles (114).

The control valve (112) serves to adjust the pressure and, separately, the flow of the glue that arrives to the nozzles (114) and, for this purpose, is provided with independent means for adjusting the pressure and flow rate of the glue.

With reference to the example shown in the drawings, the valve (112) has an inlet (112A) in which is inserted the output of the conduit (111), an output (112B) in which is inserted the input of the duct (113), and an inner chamber (112C) that connects the input (112A) with the output (112B) and in which inner chamber passes the glue coming from the duct (111), or from the pump (108). The glue flow rate is adjusted using a screw (115) operable by means of a corresponding electric actuator (116) that can be controlled by the operator via a keyboard (not shown in the drawings) or by program in function of preset values. In this way, it is possible to regulate the amount of glue dispensed through the nozzles (114) over the time. The screw (115) acts in the internal cavity (112C) of the valve (112). On the opposite side with respect to the flow adjusting screw (115), there is applied a pneumatically actuated pressure multiplier (MP), whose rod (117) acts in the chamber (112C) and is controlled by a resisting spring (118). In this way, it is also possible to adjust the output pressure of the glue from the valve (112) and, in particular, it is possible to enter glue in the pipe (113) having a pressure higher than the pressure in tube (111). On the opposite side with respect to the input (112A), on the valve (112) there is mounted a non-return valve (124), structured and functioning in a per se known manner, with adjustment screw (120) and counter-spring (121) invested on the screw (120) which acts with its front end on a closure member (122) inserted on the output of a chamber (123) of the valve (124) where the controller (115) and the pressure multiplier (116) exert their action.

Therefore, in the output section (112 B) of the valve (112) the glue is supplied at separately adjustable pressure and flow rate.

The conduit (113) supplies the nozzles (114) grafted on the distributor (119) that receives the glue from the valve (112). More particularly, the conduit (113) is connected to the distributor (119) by means of a vertical rigid tube (113B) which, over the relative engagement point (C), presents a vent for the air (SA1). At the bottom, the tube (113B) is connected on an input section of the distributor (119). The latter is provided with internal channels (1190) that connect the aforementioned input section with each of the nozzles (114). Channels (1190) are internal to the distributor (119) and are connected to two air vents (SA2), or to a vent (SA2) on each side, right and left, of the distributor (119). It goes without saying that the number of vents (SA2) may be different from that now indicated. The nozzles (114) grafted on the tube (119) are aligned along a same straight direction orthogonal to the direction (A) along which the tubes (1) advance.

The glue distribution unit may also comprise two distributors (119) with respective nozzles (114) so as to form two batteries of nozzles (114) spaced apart by a predetermined value along the direction (A) and so as to dispense glue on tubes (1), depending on the specific processing to be performed, both through a first that through a second battery of nozzles.

Figure 1:
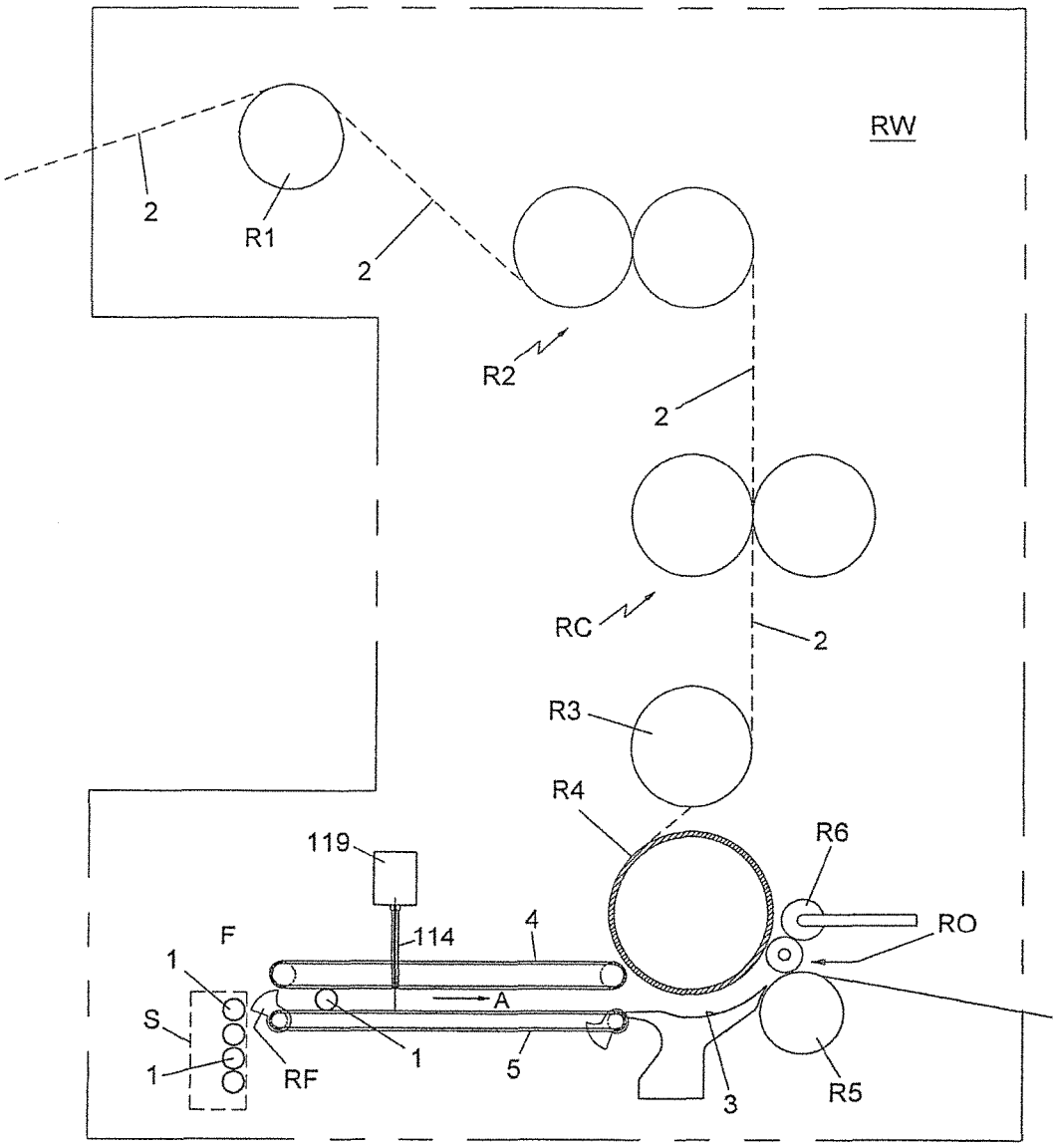
FIG. 1 is a schematic side view of a rewinder provided with a device for the implementation of a method in accordance with this invention.
Figure 2:
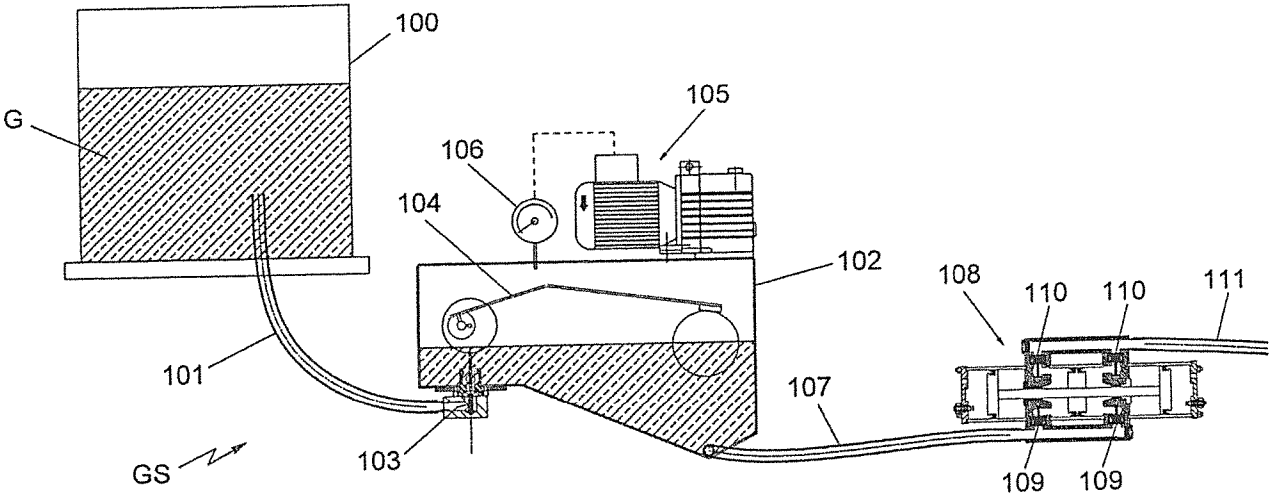
FIG. 2 represents a simplified block diagram of the glue supply unit.
Figure 3:
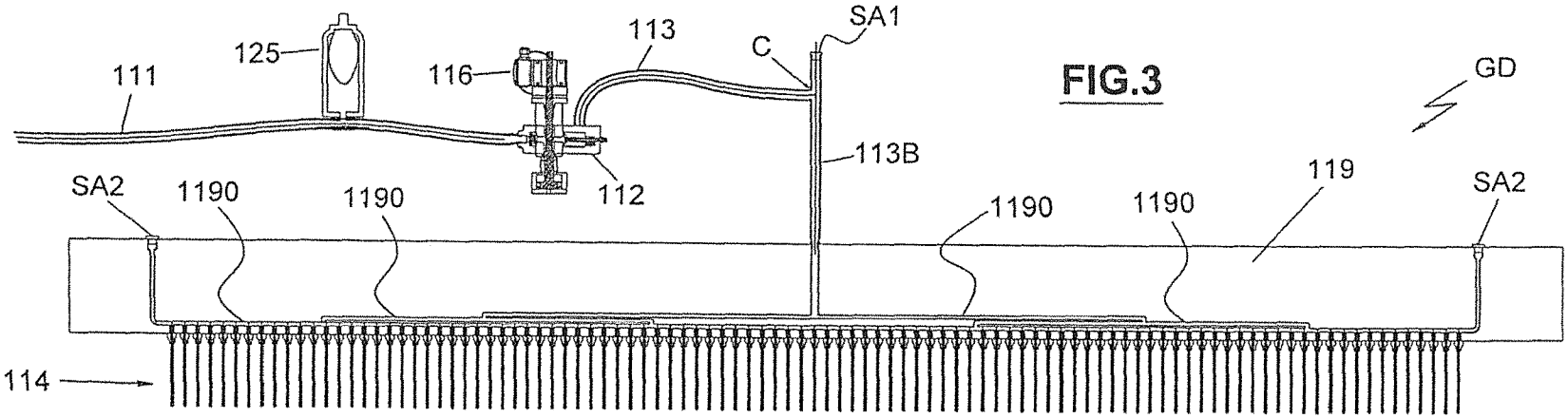
FIG. 3 is a schematic diagram of the glue distribution unit.
Figure 4:
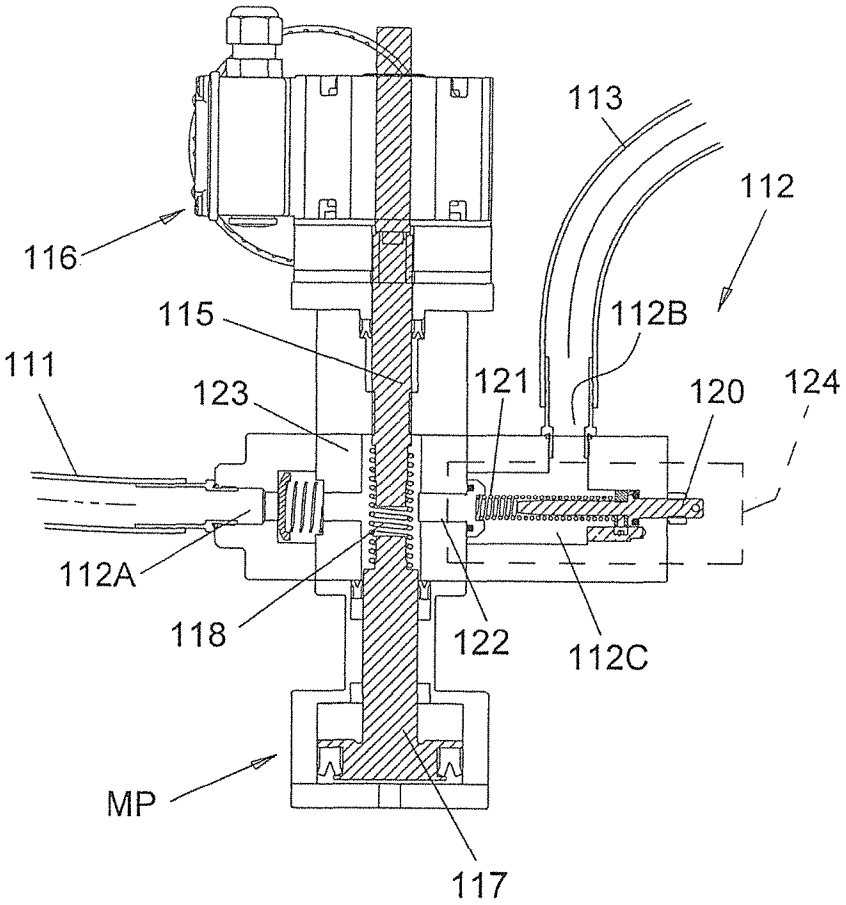
FIG. 4 is an enlarged detail of FIG. 3.

In the diagram of FIG. 3 it is shown a hydraulic accumulator (125) connected between the pump (108) and the valve (112) that can serve to ensure a constant or substantially constant pressure of the fluid introduced into the valve (112).

Advantageously, the nozzles (114) are capillary tubes at the exit of which it forms a drop (EG) with a speed that can vary in function of the geometric features of the same nozzles.

Moreover, preferably said nozzles (114) are mounted in a removable manner on the distributor (119) to be able to vary, if necessary, the capillary behavior, that is, the rate of formation of the drop of glue, by simply replacing nozzles having a certain geometry (in particular, length and internal diameter) with others having a different geometry.

Preferably, the amount of glue dispensed by each nozzle (114), that is, the volume of the drops (EG), is such as to avoid that the drops falling in the time interval that elapses between the passage of a core (1) and the subsequent core under the nozzles (114). This is favored by the concave shape (with the concavity facing downwards) of the terminal part of the nozzles (114). For example, with reference to FIG. 9, the terminal part of the nozzles (114) is conical, with an opening angle (a) comprised, for example, between 45° and 100°, and preferably equal to 90°.

In FIGS. 5-7, where the nozzles (114) and the cores (1) are not to scale to better highlight some details, the glue leaking from the nozzles (114) is indicated with the reference "EG". In FIG. 5 the core (1) is upstream of a nozzle (114). In FIG. 6 the core (1) is below the nozzle (114). In FIG. 7) the core (1) has passed the nozzle (114). The advancement of the core (1) is indicated by the arrow "A". In FIG. 7 the glue finally applied to core (1) is indicated by reference "G1". In FIG. 8 it can be seen that the nozzles (114) are suitably arranged in such a way that the distance (h) between the lower base of the same nozzles and the upper side (1D) of the cores that advance beneath them is such as to enable the cores (1) to transit freely while intercepting the glue (EG).

Advantageously, with reference to the diagram of FIG. 8, said "h" the distance between the upper side (1D) of the cores (1) transiting below the nozzles (114) and the output of the nozzles (114), and said "g" the height of the drop (EG) produced by any of the nozzles (114), "g" and "h" are of the same order of magnitude. For example, "h" has a value comprised between 0 and 1 mm, and "g" has a value comprised between 2 and 3 mm.

The path followed by the cores (1) is such that the top side of the same cores (1), while these advance under the nozzles (114), intercepts the glue (EG), coming out by the nozzles themselves. In this phase, the glue (EG) transfers by the nozzles (114) to the cores (1) without involving any intermediate member, that is, directly, and without being sprayed. In other words, in every instant of the gluing phase, the glue (EG) is on the surface of the cores (1) and on the output of the nozzles (114). Still in other words, the glue (EG), delivered by the nozzles (114) wets the outer surface of the cores (1) without that any contact between the nozzles and the cores but, unlike the spraying, the surface of the cores (1) wet by the glue (EG) will be more defined. The duration of the phase of gluing depends on the speed of the cores (1).

The mode of gluing described above allows to achieve the aims previously mentioned. In particular, it is evident that the system described above does not imply any contamination of the glue that, in fact, cannot return to the glue reservoir. At the same time, a fast flow of the cores (1) to the rewinders is allowed, since the cores in the phase of gluing does not come into contact with intermediate members and can advance beneath the nozzles (114) without stopping. Also, consumption of glue can be reduced, without compromising the quality of the gluing, as the glue flow can be adjusted. It is also noted, that, since over the time during which the glue (EG) is intercepted by the cores (1) the glue is both on the nozzles (114) and on the same cores, the application of the glue is extremely precise. In addition, there is the fact that the amount of glue dispensed by each nozzle (114) is adjustable, in particular through an adjusting device which, as seen above, from the constructive point of view is relatively simplified.

Depending on the type of gluing to be performed, several batteries of nozzles (114) can be arranged one after the other, with a predetermined interval along the direction (A) followed by the cores (1).

The glue used for the implementation of this operating method is that normally used in the production of logs made of paper material.

The glue dispensing circuit is preferably constituted by rigid elements, that is, substantially non-deformable elements, in relation to the working pressures so as to allow a regular outflow of the glue from the nozzles (114), avoiding glue feeding irregularities.

In practice, the volume of the glue contained in the feed conduits is substantially constant.

An operating method in accordance with the present invention, therefore, includes the following steps:

- sequentially feeding tubular cores (1) along a predetermined feed direction (A);
- apply from above, on each of said tubular cores (1), a predetermined amount of glue (EG) while the same cores (1) advance along said direction (A), the glue being delivered by a plurality of nozzles (114) placed transversely to the direction (A) along which the cores (1) are fed;
- as they advance along the said direction (A), the cores (1) intercept for a predetermined time the glue (EG) delivered by the nozzles (114);
- during said f time the glue (EG) is both on the nozzles (114) and on the cores (1) given the absence of elements interposed between the nozzles and the cores.

In practice, therefore, the nozzles (114) act as applicators of glue on the cores (1).

In practice all the construction details may vary in any equivalent way as for what concerns the individual elements described and illustrated, without thereby departing from the scope of the adopted solution idea and, thereby, remaining within the limits of the protection granted by this patent.

The invention claimed is:

1. A method for applying glue on tubular cores for producing logs of paper material, the method comprising:

- supplying in sequence tubular cores along a predetermined advancing direction; and
- applying a predetermined amount of glue on each of the tubular cores, the glue being applied on the tubular cores from a predetermined number of nozzles provided above the tubular cores, the tubular cores intercepting the glue released by the predetermined number of nozzles for a predetermined time interval while advancing the tubular cores along the predetermined advancing direction and without interrupting a run of the tubular cores, the glue being on the predetermined number of nozzles and the tubular cores during the predetermined time interval without any element interposed between the predetermined number of nozzles and the tubular cores.

2. A method according to claim 1, further comprising providing a gluing means comprising at least one battery of the predetermined number of nozzles, the predetermined number of nozzles being fed glue by a glue distribution unit, the glue distribution unit comprising an adjusting means for adjusting one or more of the predetermined amount of the glue and a pressure of the glue.

3. A method according to claim 2, wherein the glue distribution unit receives the glue from a supply unit, the supply unit comprising a pump, the pump feeding the glue to the glue distribution unit.

4. A method according to claim 3, wherein the pump receives the glue from a depressurized tank.

5. A method according to claim 3, wherein the adjusting means comprises an adjusting valve positioned downstream of the pump.

6. A method according to claim 3, wherein a hydraulic accumulator is arranged and acts between the pump and the adjusting means.

7. A method according to claim 1, wherein the glue released by each nozzle remains on an output of a respective nozzle, without falling, in the predetermined time interval that elapses between a passage of one of the tubular cores and the passage of a subsequent tubular core along the predetermined advancing direction.

8. A method according to claim 7, wherein a distance between an outer surface of the tubular cores passing under the nozzles and the output of the nozzles, and a height of glue drops produced by any of the nozzles are of a same order of magnitude.

9. A method according to claim 1, further comprising:

adjusting one or more of the predetermined amount of the glue applied on the tubular cores and a pressure of the glue applied on the tubular cores.

10. A method according to claim 1, wherein the predetermined amount of glue released by the nozzles is constant over the predetermined time interval.

11. A method according to claim 1, wherein the nozzles are formed by capillary tubes.

12. A method according to claim 1, wherein the nozzles are applied in a removable manner to a support.

13. A method according to claim 1, wherein the nozzles are fed glue by a hydraulic circuit provided with vents.

14. A method according to claim 1, wherein the nozzles are fed glue by a hydraulic circuit provided with conduits whose volume is constant over the predetermined time interval.

15. A method according to claim 1, wherein each nozzle releases a same amount of the glue.

16. A method according to claim 1, wherein an end portion of the nozzles is concave, with a concavity of the end portion facing downwards.

17. A method according to claim 1, wherein the glue is delivered in a form of glue drops by the nozzles.

* * * * *